US010415876B2

(12) United States Patent
Snyder et al.

(10) Patent No.: US 10,415,876 B2
(45) Date of Patent: Sep. 17, 2019

(54) HANDLE LIGHTING ASSEMBLY FOR AN APPLIANCE

(71) Applicant: Haier US Appliance Solutions, Inc., Wilmington, DE (US)

(72) Inventors: Jill Snyder, Newburgh, IN (US); Brian Culley, Newburgh, IN (US); Kari Mueller, Evansville, IN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 66 days.

(21) Appl. No.: 15/646,135

(22) Filed: Jul. 11, 2017

(65) Prior Publication Data

US 2018/0010846 A1 Jan. 11, 2018

Related U.S. Application Data

(60) Provisional application No. 62/360,683, filed on Jul. 11, 2016.

(51) Int. Cl.

| | |
|---|---|
| ***F25D 27/00*** | (2006.01) |
| ***F25D 23/02*** | (2006.01) |
| ***H05B 33/08*** | (2006.01) |

(52) U.S. Cl.

CPC ..... *F25D 27/005* (2013.01); *F25D 23/028* (2013.01); *F25D 27/00* (2013.01); *H05B 33/0857* (2013.01); *F25D 2327/001* (2013.01)

(58) Field of Classification Search

CPC ..... F25D 27/005; F25D 27/00; F25D 23/028; F25D 2327/001; H05B 33/0857

USPC ..... 165/104.17

See application file for complete search history.

(56) References Cited

U.S. PATENT DOCUMENTS

| | | | | |
|---|---|---|---|---|
| 2,680,642 | A | 6/1954 | Koeber et al. | |
| 8,108,972 | B2 | 2/2012 | Bae et al. | |
| 2008/0219002 | A1 * | 9/2008 | Sommers | A47F 3/001 362/247 |

FOREIGN PATENT DOCUMENTS

| | | | | |
|---|---|---|---|---|
| CN | 202731423 | U | 2/2013 | |
| WO | WO-2013126946 | A1 * | 9/2013 | A47B 95/02 |
| WO | WO2013126946 | A1 | 9/2013 | |
| WO | WO-2016200050 | A1 * | 12/2016 | F25D 23/028 |

* cited by examiner

*Primary Examiner* — Frantz F Jules
*Assistant Examiner* — Steve S Tanenbaum
(74) *Attorney, Agent, or Firm* — Dority & Manning, P.A.

(57) ABSTRACT

A handle lighting assembly for an appliance includes features that allow a consumer to readily change the color of the light emitted from the handle lighting assembly as desired. In one exemplary aspect, the handle lighting assembly includes features that allow a consumer to readily interchange colored films to and from the handle lighting assembly based on the desired emitted light color.

20 Claims, 14 Drawing Sheets

HANDLE LIGHTING ASSEMBLY FOR AN APPLIANCE

CROSS-REFERENCE TO RELATED APPLICATIONS

The present application claims the benefit of U.S. Provisional Patent Application No. 62/360,683, filed on Jul. 11, 2016, which is hereby incorporated by reference in its entirety.

FIELD OF THE INVENTION

The present subject matter relates generally to appliances and more particularly to handle lighting assemblies for appliances.

BACKGROUND OF THE INVENTION

Certain appliances include handle lighting assemblies operatively configured to emit colored light so as to improve the aesthetic appearance or ease of use of the appliance. Such conventional handle lighting assemblies have included a color changing light source (e.g., color changing LEDs) so that various colors of light can be emitted from the handle lighting assembly, such as e.g., a red, green, or blue light. However, such color changing light sources typically offer only a finite number of color choices, limiting consumer lighting options. Other conventional handle lighting assemblies have included a light source configured to emit a single color of light. Such conventional handle lighting assemblies also limit consumer lighting options.

In some instances, a consumer may desire to change the color of the light emitted from the handle lighting assembly of their appliance. To change the color of the light emitted from certain conventional handle lighting assemblies, consumers have been forced to remove the entire door or handle to replace the light source. In this way, conventional handle lighting assemblies have not provided consumers with a readily available means for changing the color of the emitted light post-purchase of their appliance.

Accordingly, a handle lighting assembly for an appliance that addresses one or more of the noted challenges would be useful.

BRIEF DESCRIPTION OF THE INVENTION

The present subject matter provides a handle lighting assembly for an appliance that includes features that allow a consumer to readily change the color of the light emitted from the handle lighting assembly as desired. In one exemplary aspect, the handle lighting assembly includes features that allow a consumer to readily interchange colored films to and from the handle lighting assembly based on the desired emitted light color. Additional aspects and advantages of the invention will be set forth in part in the following description, or may be apparent from the description, or may be learned through practice of the invention.

In one exemplary aspect, the present subject matter is directed to a refrigerator appliance. The refrigerator appliance includes a cabinet and a door rotatably hinged with the cabinet. The refrigerator appliance also includes a handle assembly connected with or integrally formed with the door and having a handle body defining a recess. The handle assembly includes a lighting assembly connected to the handle body and disposed within the recess. The lighting assembly includes an elongated body having a length extending between a first end and a second end and having a lens extending along at least a portion of the length. The lighting assembly further includes a light source. The lighting assembly also includes an end cap integral with or operatively connected to the elongated body at one of the first end and the second end, the end cap defining a slit. In addition, the lighting assembly includes a film removably insertable into the slit. When the film is inserted into the slit, the film is positioned between the light source and the lens.

In some embodiments, the end cap defines an access recess positioned on opposing sides of the slit, and wherein the access recess allows for removal and insertion of the film within or from the slit.

In some embodiments, the end cap defines an access cutout contiguous with the access recess for providing access to the film.

In some embodiments, the lens has an arcuate shape.

In some embodiments, the lens extends substantially along the entire length of the elongated body.

In some embodiments, the light source includes a plurality of LEDs spaced apart from one another and disposed along the length of the elongated body.

In some embodiments, the end cap is a first end cap connected to the first end of the elongated body. In such embodiments, the handle lighting assembly further includes a second end cap connected to the second end of the elongated body and defining a slit. In such embodiments, when the film is inserted into the slit of the first end cap, the film is received within the slit of the second end cap.

In some embodiments, the film comprises a transparent or translucent material.

In some embodiments, the film extends substantially along the entire length of the elongated body.

In some embodiments, the refrigerator appliance defines a lateral direction. The cabinet of the refrigerator appliance extending between a first side and a second side along the lateral direction. In such embodiments, the door is rotatably hinged at the first side of the cabinet. In such embodiments, the refrigerator appliance further includes a second door rotatably hinged to the second side of the cabinet. The refrigerator appliance also includes a handle assembly connected with or integrally formed with the second door and having a handle body defining a recess. The refrigerator appliance also includes a handle lighting assembly connected to the handle body and disposed within the recess defined by the handle body of the second door. The handle lighting assembly including an elongated body having a length extending from a first end to a second end and having a lens extending along at least a portion of the length. The handle lighting assembly also including a light source and an end cap operatively connected with the elongated body at one of the first end and the second end, the end cap defining a slit. The handle lighting assembly further includes a film removably insertable into the slit. In such embodiments, when the film is inserted into the slit, the film is positioned between the light source and the lens. Moreover, in such embodiments, when the door and the second door are in a closed position, the recess defined by the handle body of the door and the recess defined by the handle body of the second door define an illumination recess, and wherein a gap is defined between the door and the second door along the lateral direction such that when one or more of the light sources of the respective handle lighting assemblies emit light, the light from within the illumination recess is visible from an exterior of the refrigerator appliance.

In some embodiments, the light source is disposed along at least a portion of the length of the elongated body.

In another exemplary aspect, the present subject matter is directed to a handle assembly for an appliance. The handle assembly includes a handle body defining a recess. The handle assembly also includes a lighting assembly connected to the handle body and disposed within the recess. The lighting assembly includes an elongated body having a length extending from a first end to a second end and having a lens extending along at least a portion of the length. The lighting assembly also includes a light source. The lighting assembly further includes an end cap operatively connected with the elongated body at one of the first end and the second end, the end cap defining a slit. Moreover, the lighting assembly includes a film removably insertable into the slit. When the film is inserted into the slit, the film is positioned between the light source and the lens.

In some embodiments, the handle body is formed integrally with the appliance.

In some embodiments, the end cap includes one or more guide members for guiding the film into and out of the slit, the guide members extending at least partially along the length of the elongated body.

In some embodiments, the elongated body defines an opening positioned along the length of the elongated body, and wherein the end cap includes a connection member extending at least partially along the length of the elongated body, the connection member having connecting portion operatively configured to snap into the opening to secure the end cap to the elongated body thereto.

In some embodiments, the slit is defined as an arcuate shape and the lens has an arcuate shape, and wherein the lens is oriented with a convex shape with respect to the light source, and wherein when the film is inserted into the slit, the film is oriented with a concave shape with respect to the light source.

In some embodiments, the end cap defines an access recess positioned on opposing sides of the slit, and wherein the access recess allows for removal and insertion of the film within or from the slit, and wherein the end cap defines an access cutout contiguous with the access recess for providing access to the film.

In some embodiments, the handle body defines at least two indents, and wherein the end cap has a body and tabs projecting outward from the body, and wherein the tabs are operatively configured to be received within the indents.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
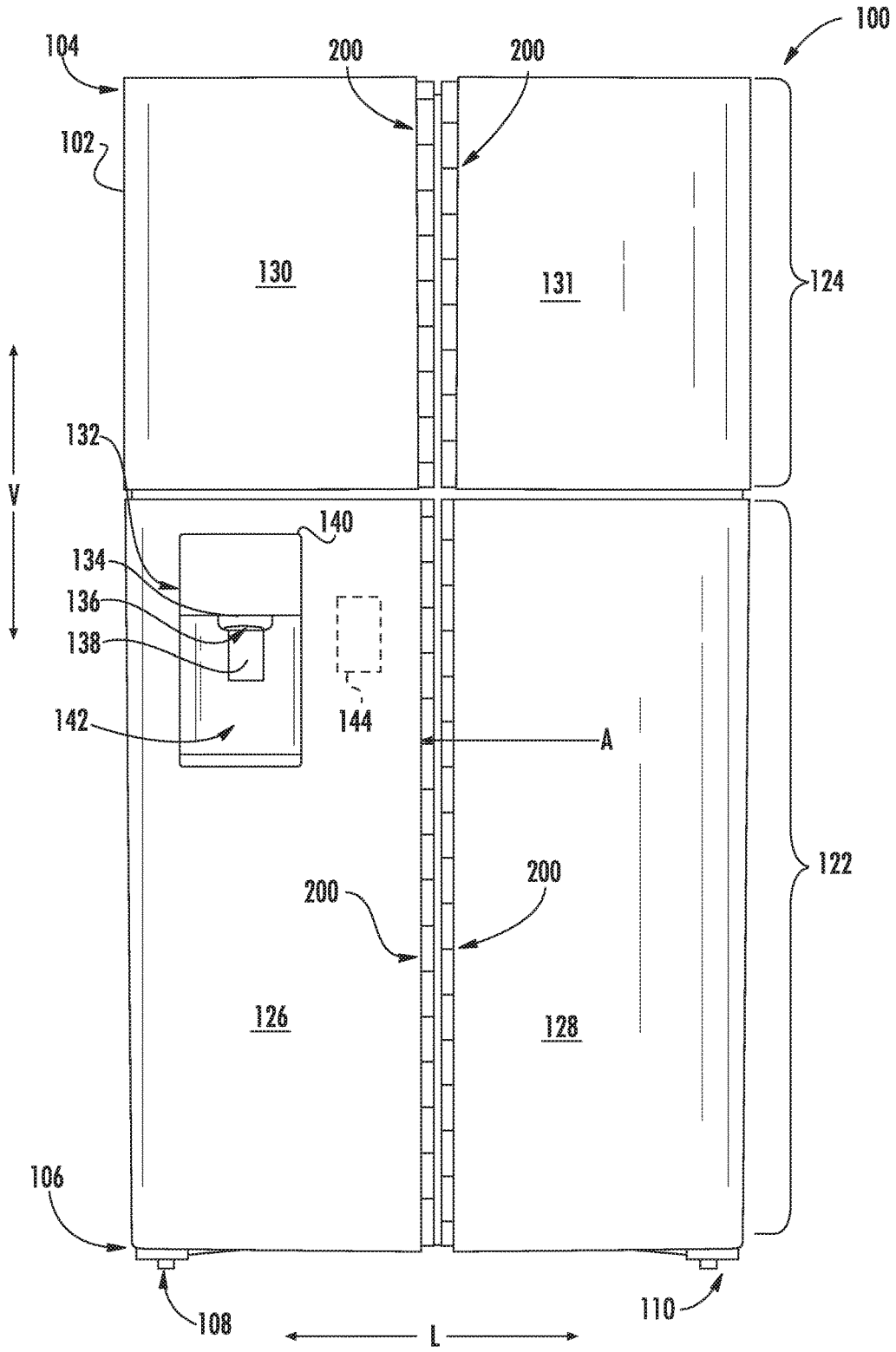
FIG. 1 provides a front view of an exemplary refrigerator appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a front view of a refrigerator appliance 100 according to an exemplary embodiment of the present subject matter. Refrigerator appliance 100 includes a housing or cabinet 102 that extends between a top 104 and a bottom 106 along a vertical direction V, between a first side 108 and a second side 110 along a lateral direction L, and between a front side and a rear side along a transverse direction T (a direction into and out of the page in FIG. 1). Each of the vertical direction V, lateral direction L, and transverse direction T are mutually perpendicular to one another and form an orthogonal direction system.

Cabinet 102 defines chilled chambers for receipt of food items for storage. In particular, cabinet 102 defines fresh food chamber 122 positioned at or adjacent bottom 106 of cabinet 102 and a freezer chamber 124 arranged at or adjacent top 104 of cabinet 102. As such, refrigerator appliance 100 is generally referred to as a top mount or top freezer refrigerator. It is recognized, however, that the benefits of the present disclosure apply to other types and styles of refrigerator appliances as well, such as e.g., a bottom mount refrigerator appliance or a side-by-side style refrigerator appliance. Consequently, the description set forth herein is for illustrative purposes and is not intended to be limiting in any aspect to any particular refrigerator configuration or style. Moreover, while the present subject matter is described herein as pertaining to handles and lighting assemblies for refrigerator appliances, the teachings and scope of the present subject matter are also applicable to other types of appliances. For example, the structure and configuration of the exemplary handle lighting assemblies described and illustrated herein may also be applicable to other appliances with doors and/or handles, including but not limited to washers, dryers, microwaves, freezers, ovens, etc.

Refrigerator appliance 100 can include one or more doors. For this exemplary embodiment, refrigerator appliance includes refrigerator doors and freezer doors configured in a quad door configuration. As shown in FIG. 1, refrigerator doors 126, 128 are rotatably hinged to an edge of cabinet 102 for selectively accessing fresh food chamber 122. In particular, first refrigerator door 126 is rotatably hinged to cabinet 102 proximate first side 108 and second refrigerator door 128 is rotatably hinged proximate second side 110 of refrigerator appliance 100. Similarly, freezer doors 130, 131 are rotatably hinged to an edge of cabinet 102 for selectively accessing freezer chamber 124. More specifically, for this embodiment, first freezer door 130 is rotatably hinged to cabinet 102 proximate first side 108 and second freezer door 131 is rotatably hinged proximate second side 110 of refrigerator appliance 100. To prevent leakage of cool air, refrigerator doors 126, 128, freezer doors 130, 131 and/or cabinet 102 may define one or more sealing mechanisms (e.g., rubber gaskets) at the interface where the doors 126, 128, 130, 131 meet cabinet 102. Refrigerator doors 126, 128 and freezer doors 130, 131 are shown in a closed configuration in FIG. 1. It should be appreciated that doors having a different style, position, or configuration are possible and within the scope of the present subject matter.

Refrigerator appliance 100 also includes a dispensing assembly 132 for dispensing liquid water and/or ice. Dispensing assembly 132 includes a dispenser 134 positioned on or mounted to an exterior portion of refrigerator appliance 100, e.g., on refrigerator door 126. Dispenser 134 includes a discharging outlet 136 for accessing ice and liquid water. An actuating mechanism 138, shown as a paddle, is mounted below discharging outlet 136 for operating dispenser 134. In alternative exemplary embodiments, any suitable actuating mechanism may be used to operate dispenser 134. For example, dispenser 134 can include a sensor (such as an ultrasonic sensor) or a button rather than the paddle. A control panel 140 is provided for controlling the mode of operation. For example, control panel 140 includes a plurality of user inputs (not labeled), such as a water dispensing button and an ice-dispensing button, for selecting a desired mode of operation such as crushed or non-crushed ice.

Discharging outlet 136 and actuating mechanism 138 are an external part of dispenser 134 and are mounted in a dispenser recess 142. Dispenser recess 142 is positioned at a predetermined elevation convenient for a user to access ice or water and enabling the user to access ice without the need to bend-over and without the need to open refrigerator doors 126, 128. In the exemplary embodiment of FIG. 1, dispenser recess 142 is positioned at a level that approximates the waist level of an adult user. According to an exemplary embodiment, the dispensing assembly 132 may receive ice from an icemaker disposed in a sub-compartment of the fresh food chamber 122 or disposed within the freezer chamber 124.

Refrigerator appliance 100 further includes a controller 144. Operation of the refrigerator appliance 100 is controlled by controller 144. In some exemplary embodiments, control panel 140 can represent a general purpose I/O ("GPIO") device or functional block. In some exemplary embodiments, control panel 140 can include input components, such as one or more of a variety of electrical, mechanical or electro-mechanical input devices including rotary dials, push buttons, touch pads, and touch screens. Control panel 140 can be communicatively coupled with controller 144 via one or more signal lines or shared communication busses. Additionally or alternatively, control panel 140 can be communicatively coupled with controller 144 via one or more wireless connections. Control panel 140 provides selections for user manipulation of the operation of refrigerator appliance 100. In response to user manipulation of control panel 140, controller 144 operates various components of refrigerator appliance 100. For example, controller 144 is operatively coupled or in communication with various components of a handle lighting assembly, as discussed below.

Controller 144 includes memory and one or more processing devices such as microprocessors, CPUs or the like, such as general or special purpose microprocessors operable to execute programming instructions or micro-control code associated with operation of refrigerator appliance 100. The memory can represent random access memory such as DRAM, or read only memory such as ROM or FLASH. The processor executes programming instructions stored in the memory. The memory can be a separate component from the processor or can be included onboard within the processor. Alternatively, controller 144 may be constructed without using a microprocessor, e.g., using a combination of discrete analog and/or digital logic circuitry (such as switches, amplifiers, integrators, comparators, flipflops, AND gates, and the like) to perform control functionality instead of relying upon software.

With reference still to FIG. 1, each door 126, 128, 130, 131 of refrigerator appliance 100 includes a handle assembly 200 for accessing one of the chilled chambers 122, 124 of refrigerator appliance 100. For the exemplary illustrated embodiment of FIG. 1, handle assembly 200 of each door 126, 128, 130, 131 is configured as a pocket handle and each handle assembly 200 extends generally along the vertical direction V along the length of its respective door 126, 128, 130, 131 as shown. However, in some exemplary embodiments, handle assemblies 200 need not extend the length of their respective doors. For instance, handle assemblies 200 can extend along the vertical direction V half of the length of their respective doors 126, 128, 130, 131.

Various forms of pocket handles may be used to move refrigerator doors 126, 128 or freezer doors 130, 132 between an open and closed position. Pocket handles are generally integral to the door and are created by forming a recess in a door body. For example, a hand grip recess may be created on the side or front surface of a door, thereby allowing a user to manipulate the door. Pocket handles can be different sizes, depths, and locations so as to enable a user to grip the door. For example, as shown in FIG. 1, pocket handles can be used to open and close each of the pair of refrigerator doors 126, 128 or freezer doors 130, 132.

In accordance with exemplary embodiments of the present subject matter, one or more handle assemblies 200 of refrigerator appliance 100 include a handle lighting assembly operatively configured to emit light from their respective handle assemblies 200. In particular, for the exemplary embodiment of FIG. 1, refrigerator appliance 100 is shown emitting blue light (as shown by the lateral lines along the handle assemblies 200). In this way, the aesthetic appearance and ease of use of refrigerator appliance 100 can be enhanced. As described more fully below, the handle lighting assemblies include features for changing the color of the light emitted from their respective handle assemblies 200.

Figure 2:
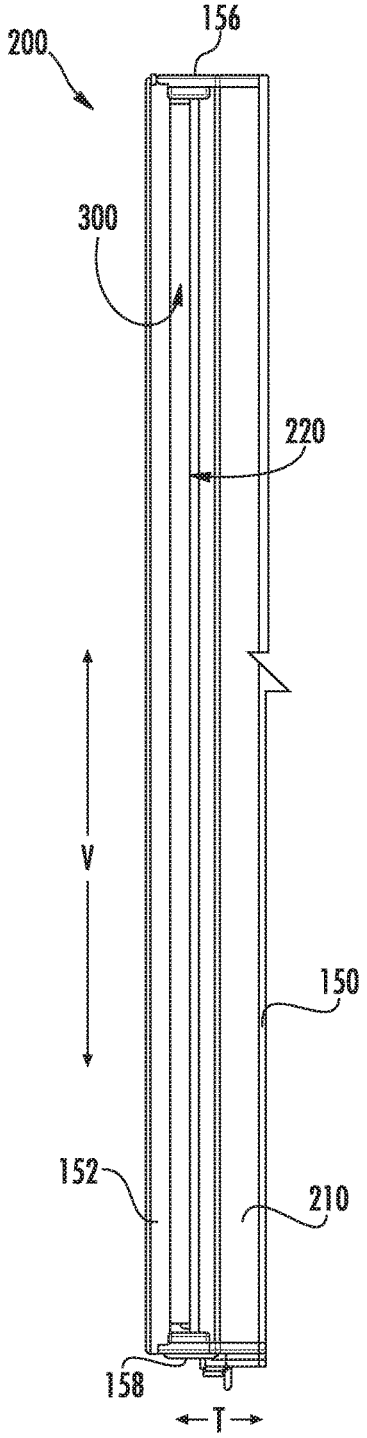
FIG. 2 provides a side elevation view of one refrigerator door of the refrigerator appliance of FIG. 1 depicting a handle assembly.
Figure 3:
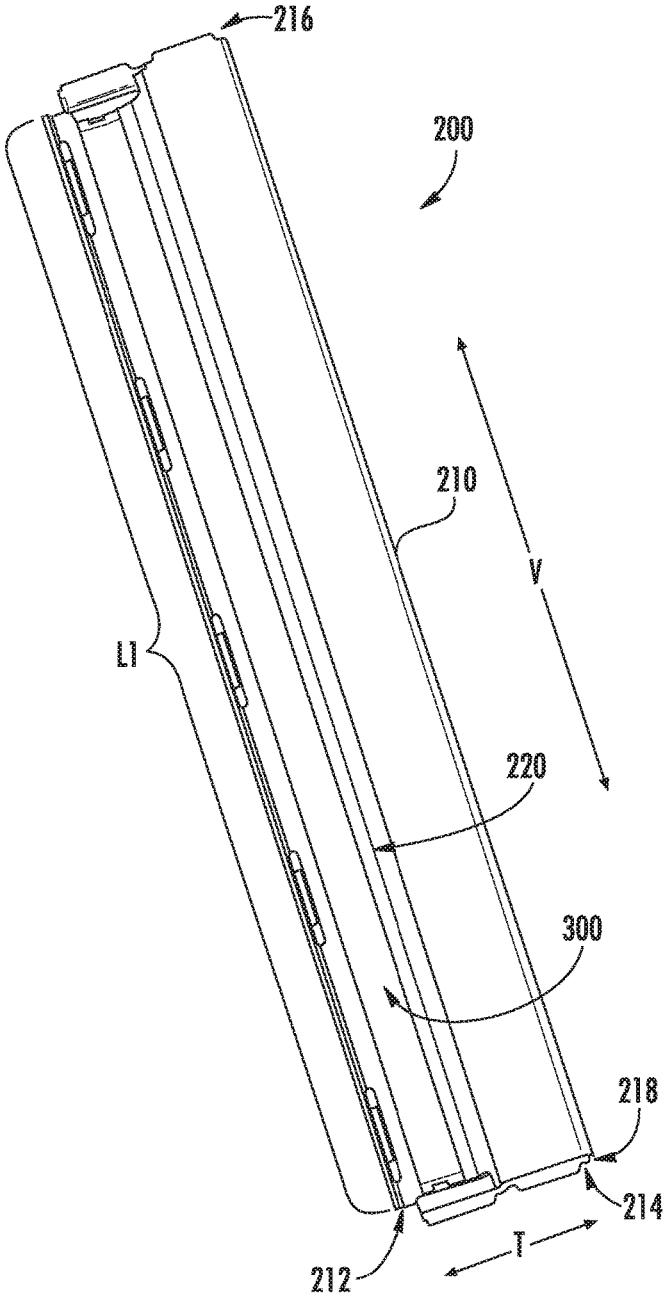
FIG. 3 provides a perspective view of the exemplary handle assembly of FIG. 2.

Referring now to FIGS. 2 and 3, FIG. 2 provides a side elevation view of refrigerator door 126 of the exemplary refrigerator appliance 100 of FIG. 1 depicting handle assembly 200. In particular, FIG. 2 provides a side view of handle assembly 200 of refrigerator door 126 from View A of FIG. 1. FIG. 3 provides a perspective view of handle assembly 200 thereof removed from door 126 for illustrative purposes. For this exemplary embodiment, handle assembly 200 is configured as a pocket handle, as noted above.

As shown in FIGS. 2 and 3, handle assembly 200 includes a handle body 210. Handle body 210 extends between a front 212 and a rear 214 along the transverse direction T (FIG. 3), and for this embodiment, handle body 210 is disposed between an inner wall 150 and an outer wall 152 of refrigerator door 126 (FIG. 2). Handle body 210 also extends between a top 216 and a bottom 218 along the vertical direction V (FIG. 3), and for this embodiment, handle body 210 is disposed between a top wall 156 and a bottom wall 158 of refrigerator door 126 (FIG. 2). Handle body 210 can be formed integrally with refrigerator door 126 or can be a component separate from the door. Handle body 210 defines a recess 220. Recess 220 is defined along the vertical direction V substantially along a length L1 of handle body 210 (FIG. 3). To open refrigerator door 126, a user can reach into recess 220 and can pull refrigerator door 126 open.

As further shown in FIGS. 2 and 3, handle assembly 200 includes a handle lighting assembly 300 connected to handle body 210. In particular, for this embodiment, handle lighting assembly 300 is disposed within recess 220 defined by handle body 210. In alternative exemplary embodiments, handle lighting assembly 300 can be formed integrally with handle body 210. Moreover, for this embodiment, handle lighting assembly 300 extends substantially along the length L1 of handle body 210. In alternative embodiments, handle lighting assembly 300 need not extend substantially along the length L1 of handle body 210. For instance, handle lighting assembly 300 can extend half the length L1 of handle body 210.

Figure 4:
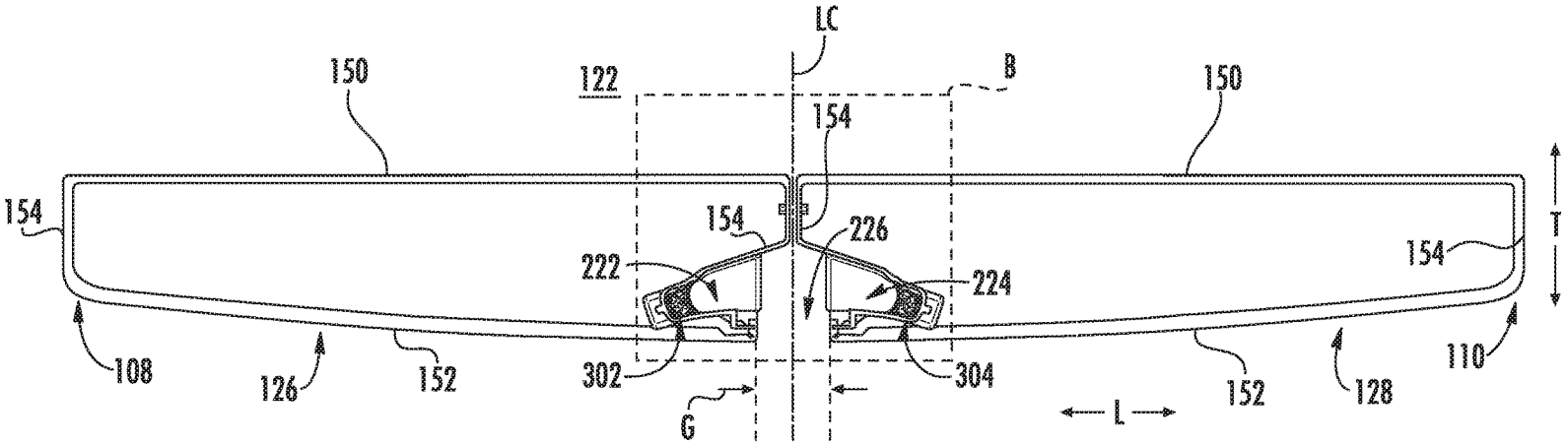
FIG. 4 provides a cross-sectional view of doors of the exemplary refrigerator appliance of FIG. 1 in a closed configuration.

FIG. 4 provides a cross-sectional view of refrigerator doors 126, 128 of the exemplary refrigerator appliance 100 of FIG. 1 in a closed configuration. As noted above, refrigerator door 126 of refrigerator appliance 100 includes inner wall 150 and outer wall 152. Inner wall 150 generally defines a portion of the interior of fresh food chamber 122 when door 126 is in a closed position. Outer wall 152 is generally opposite inner wall 150 and defines a portion of the exterior of refrigerator appliance 100 when door 126 is in the closed position. Door 126 includes side walls 154 extending between and connecting inner wall 150 and outer wall 152. A foam or other insulating material is disposed between inner wall 150 and outer wall 152 along the transverse direction T, as well as between the side walls 154 along the lateral direction L. For this exemplary embodiment, handle body 210 forms side wall 154 proximate a lateral centerline LC defined by refrigerator appliance 100 along the lateral direction L. As shown in FIG. 4, refrigerator door 128 can be configured in the same or similar manner as refrigerator door 126. Moreover, although not shown in FIG. 4, freezer doors 130, 131 can likewise include inner, outer, and side walls 150, 152, 154 as shown and described for refrigerator door 126.

As further shown in FIG. 4, when refrigerator doors 126, 128 are in a closed position, first recess 222 defined by handle body 210 of refrigerator door 126 and second recess 224 defined by handle body 210 of refrigerator door 128 define an illumination recess 226. Moreover, a gap G is defined between refrigerator door 126 and refrigerator door 128 along the lateral direction L such that when one or more of the light sources of the respective first and second handle lighting assemblies 302, 304 emit light, the light from within the illumination recess 226 escapes through gap G and thus may be visible from an exterior of refrigerator appliance 100 (e.g., FIG. 1). In this manner, the aesthetic appearance and ease of use of refrigerator appliance 100 can be enhanced.

Figure 5:
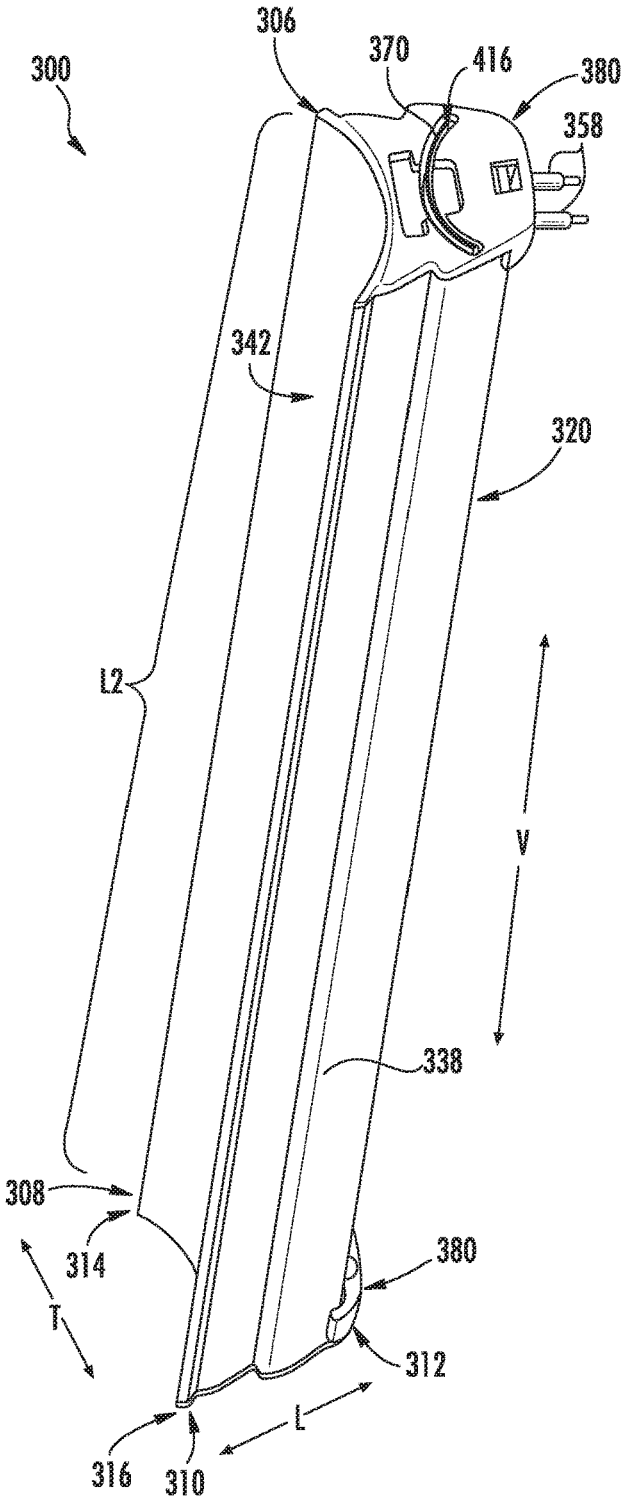
FIG. 5 provides a perspective view of an exemplary handle lighting assembly of the handle assembly of FIG. 2.
Figure 6:
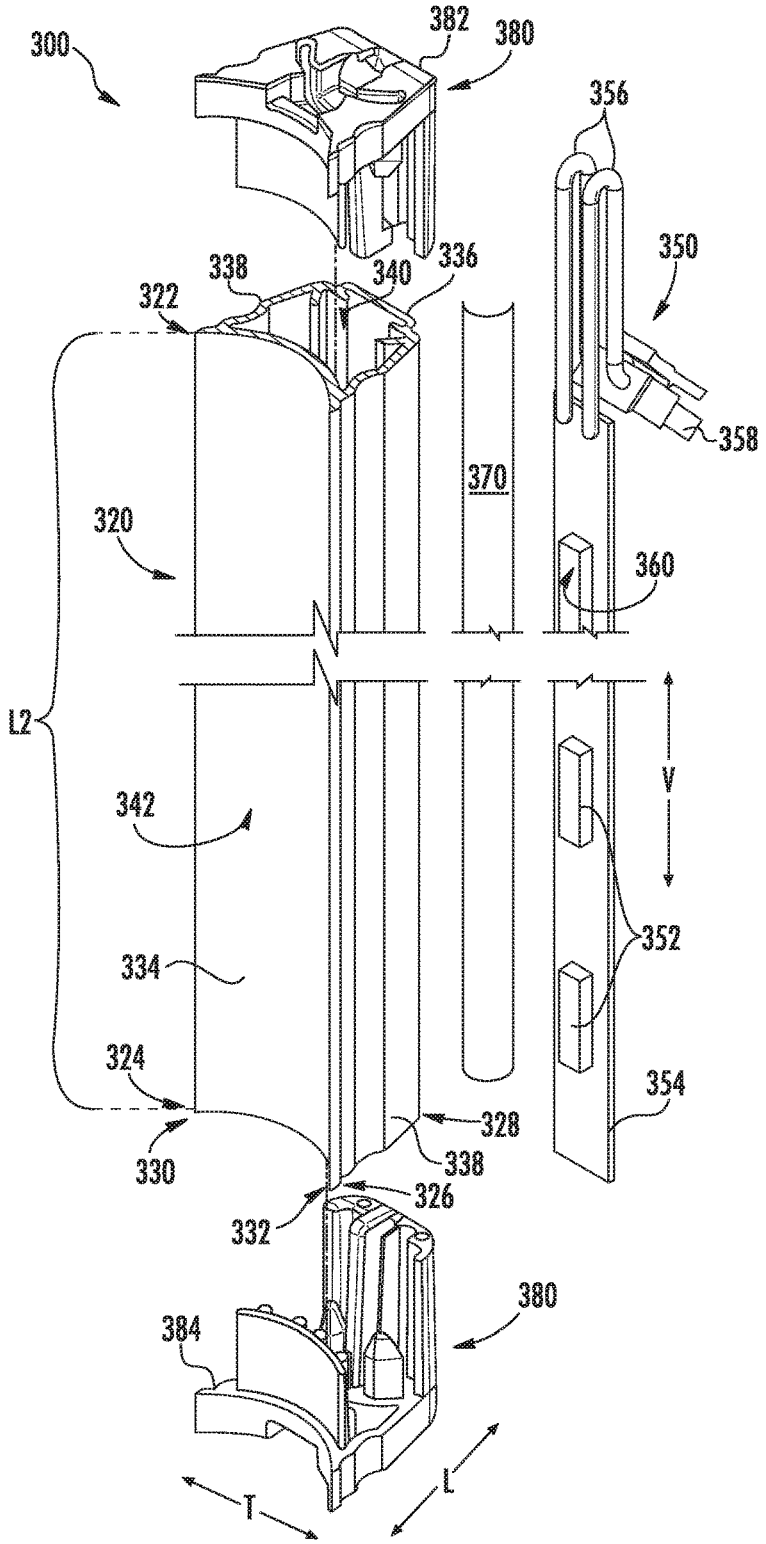
FIG. 6 provides an exploded, perspective view of the lighting assembly of FIG. 5.

Referring now to FIGS. 5 and 6, FIG. 5 provides an assembled view of handle lighting assembly 300 of the exemplary handle assembly 200 of FIG. 2. FIG. 6 provides an exploded thereof. As shown in FIG. 5, handle lighting assembly 300 extends between a top 306 and a bottom 308 along the vertical direction V, between a front 310 and a rear 312 along the lateral direction L, and between a first side 314 and a second side 316 along the transverse direction T.

As shown in FIG. 6, for this embodiment, handle lighting assembly 300 includes an elongated body 320. Elongated body 320 extends between a top end 322 and a bottom end 324 along the vertical direction V. Elongated body 320 has a length L2 extending substantially between top end 322 and bottom end 324 along the vertical direction V (FIG. 5). Elongated body 320 also extends between a front 326 and a rear 328 along the lateral direction L and between a first side 330 and a second side 332 along the transverse direction T. Elongated body 320 includes a front wall 334, a rear wall 336, and sidewalls 338 extending therebetween and connecting front wall 334 and rear wall 336. Elongated body 320 is a generally hollow body as shown in FIG. 6. Front wall 334, rear wall 336, and sidewalls 338 of elongated body 320 define a body cavity 340.

Front wall 334 of elongated body 320 includes a lens 342. Lens 342 extends along at least a portion of the length L2 of elongated body 320. In particular, for this embodiment, lens 342 extends substantially along the length L2 of elongated body 320. Lens 342 also extends between first side 330 and second side 332 of elongated body 320. Moreover, as shown in FIGS. 5 and 6 for this exemplary embodiment, lens 342 has an arcuate shape.

As shown further in FIG. 5, the handle lighting assembly 300 includes a light assembly 350. For this embodiment, light assembly 350 includes one or more light sources 352 positioned along an elongated strip 354. The light sources 352 can be any suitable type of light source, such as e.g., LEDs, incandescent, halogen, fluorescent, high intensity discharge, a combination of the foregoing, etc. For this embodiment, elongated strip 354 extends along the vertical direction V substantially the length L2 of elongated body 320. Light sources 352 are spaced apart and disposed along elongated strip 354 along the vertical direction V.

Light assembly 350 also includes wire guides 356 and electrical connectors 358. Electrical connectors 358 and wires disposed within wire guides 356 provide electrical communication between the light sources 352 and a power source, such as e.g., a line voltage or a battery. The electrical connectors 358 connect the components of light assembly 350 with the power source. The light sources 352 can be in electrical communication with one another in series or in parallel. Moreover, each of the light sources 352 can be communicatively coupled with controller 144. For this embodiment, controller 144 is operatively configured to control the lumen intensity of the plurality of light sources 352. As such, controller 144 can dim or turn off the one or more light sources 352 in accordance with a set schedule or upon a user input.

As shown in FIGS. 5 and 6, handle lighting assembly 300 further includes film 370. Film 370 is removably insertable from handle lighting assembly 300. Stated differently, film 370 can be inserted into or removed from handle lighting assembly 300. For instance, in FIG. 5, film 370 is shown inserted into handle lighting assembly 300. Film 370 is operatively configured to change a color of light emitted from handle lighting assembly 300. Film 370 can be any suitable color (e.g., red, green, blue, purple, pink, teal, orange, yellow, indigo, violet, etc.) to create a desired hue from refrigerator appliance 100. Film 370 can be formed from any suitable transparent or translucent material. For example, film 370 can be a transparent vinyl with a scratch resistant coating.

With reference still to FIGS. 5 and 6, handle lighting assembly 300 also includes end caps 380, and more particularly for this embodiment, handle lighting assembly 300 includes a first end cap 382 and a second end cap 384. First end cap 382 is operatively configured to connect at or adjacent top end 322 of elongated body 320. Second end cap 384 is operatively configured to connect at or adjacent bottom end 324 of elongated body 320. Moreover, for this embodiment, first end cap 382 and second end cap 384 are configured in the same manner, except that first end cap 382 is oriented right side up to connect to elongated body 320 at top end 322 and second end cap 384 is oriented upside down to connect to elongated body 320 at bottom end 324. In addition, first and second end caps 382, 384 are illustrated as separate components of handle lighting assembly 300 in the illustrated embodiments of FIGS. 5 and 6. However, in some exemplary embodiments, first and second end caps 382, 384 can be formed integrally with handle lighting assembly 300. For instance, elongated body 320 and first and second end caps 382, 384 can be formed as a single monolithic piece by a suitable manufacturing technique, such as e.g., an additive manufacturing technique.

Figure 8:
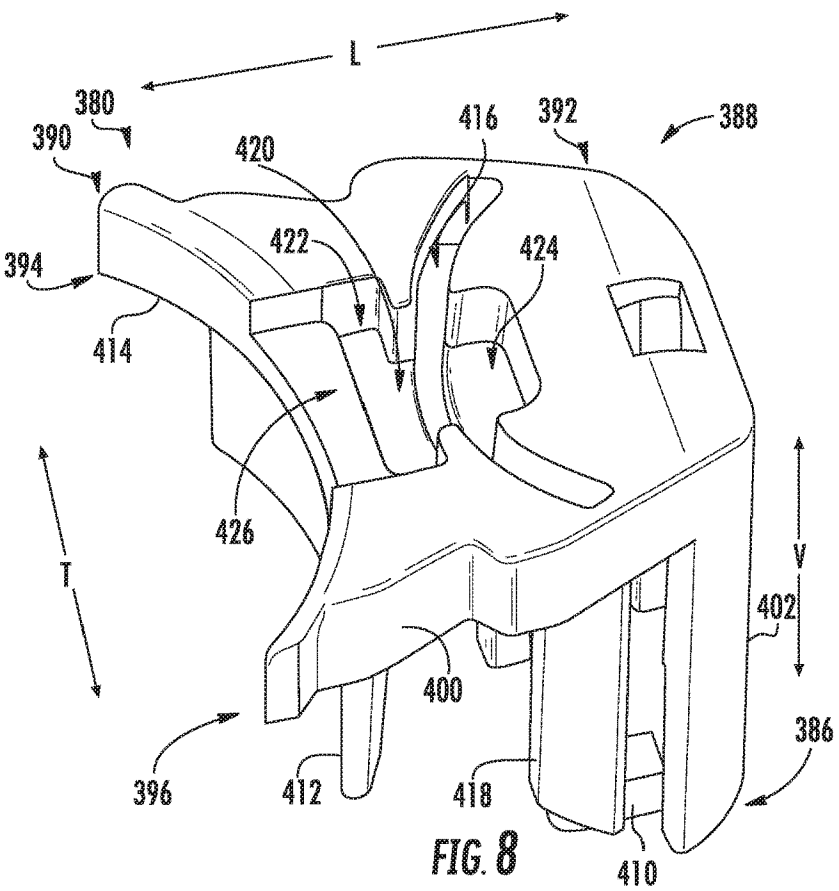
FIG. 8 provides a close up, top perspective view of the end cap of FIG. 7.
Figure 7:
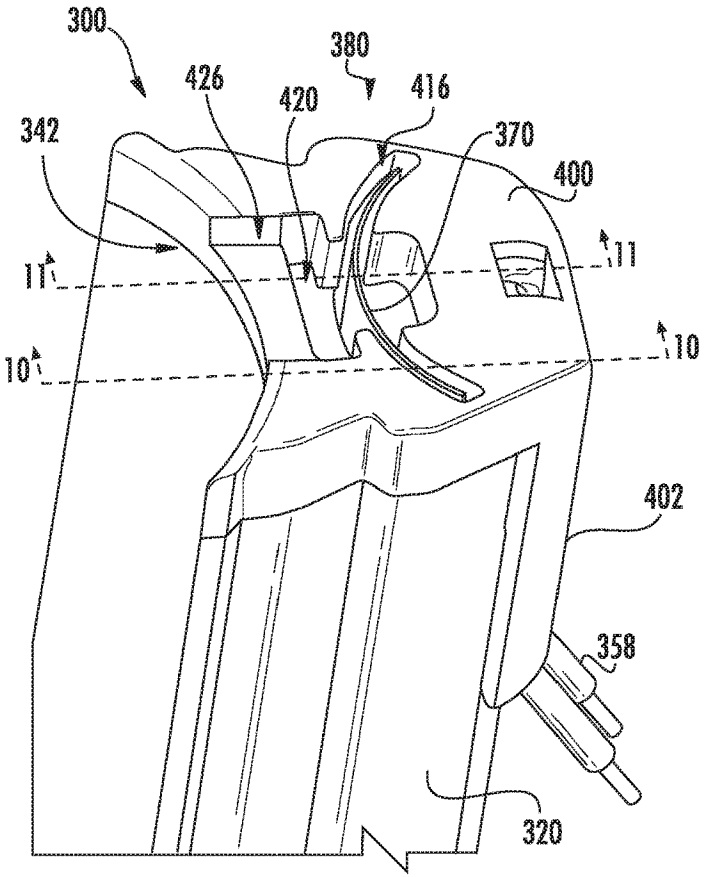
FIG. 7 provides a close up, perspective view of an exemplary end cap connected to an exemplary elongated body of the lighting assembly of FIG. 5.
Figure 10:
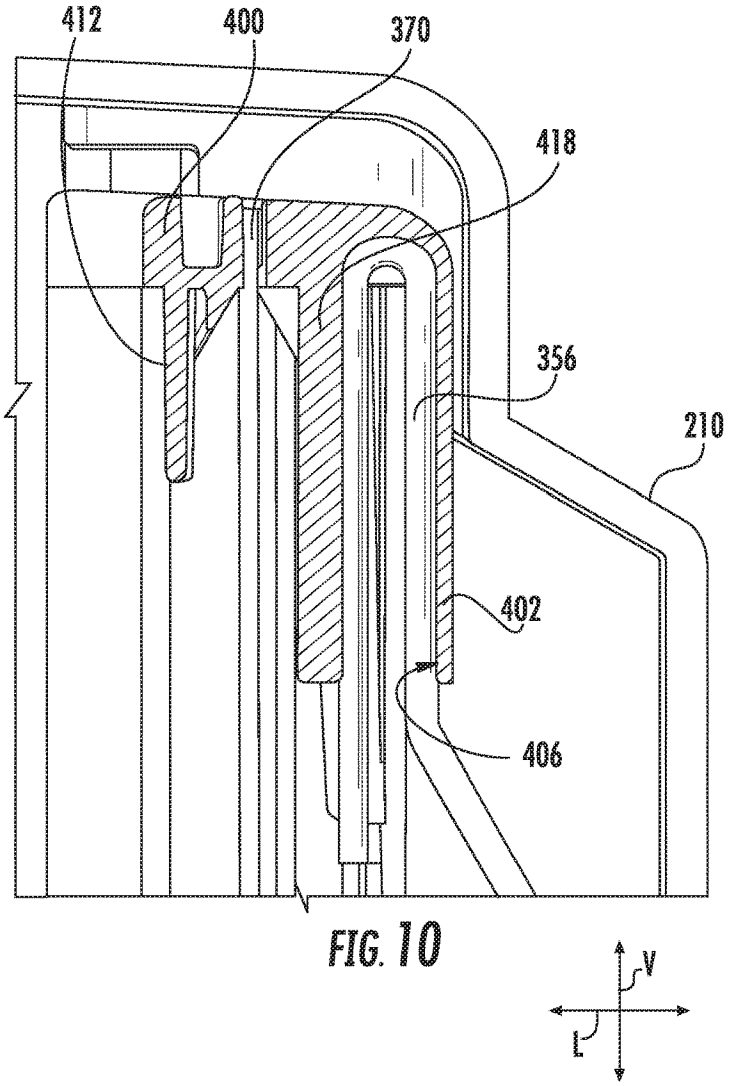
FIG. 10 provides a cross-sectional view of the end cap 380 of FIG. 7 taken on line 10-10.
Figure 9:
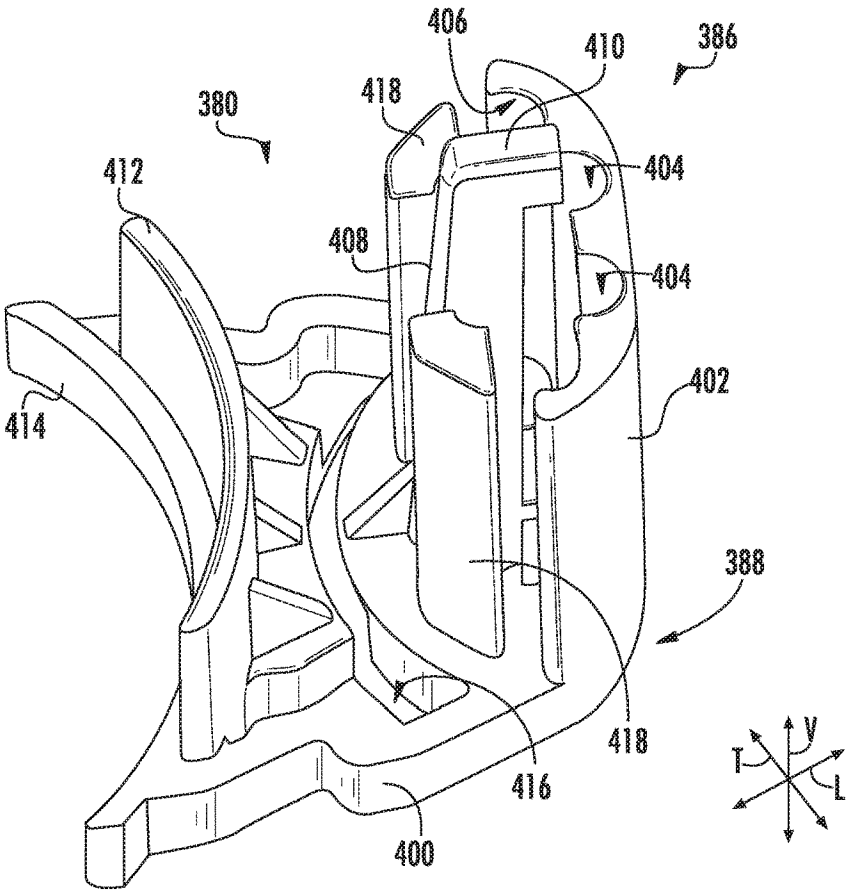
FIG. 9 provides a close up, bottom perspective view of the end cap of FIG. 7.
Figure 11:
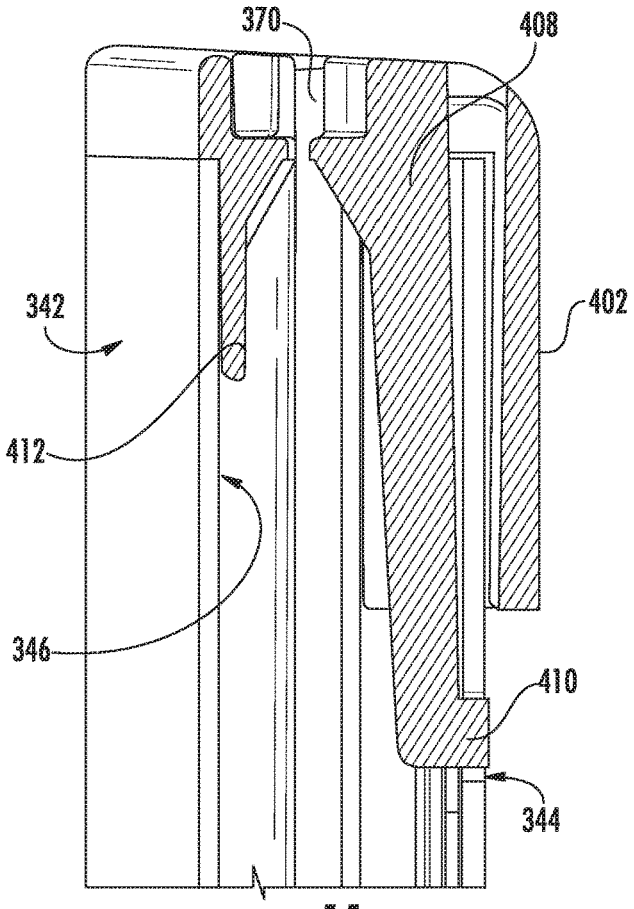
FIG. 11 provides a cross-sectional view of an end cap 380 connected to an exemplary elongated body taken on line 11-11 of FIG. 7.

Referring now to FIGS. 7 through 11, an exemplary embodiment of end cap 380 is provided. In particular, FIG. 7 provides a close up, perspective view of end cap 380 connected to elongated body 320 of the exemplary handle lighting assembly 300 of FIG. 5. FIG. 8 provides a close up, top perspective view of the exemplary end cap 380 of FIG. 7 and FIG. 9 provides a close up, bottom perspective view thereof. FIG. 10 provides a cross-sectional view of end cap 380 taken on line 10-10 of FIG. 7. FIG. 11 provides a cross-sectional view of end cap 380 taken on line 11-11 of FIG. 7.

As shown particularly in FIG. 8, end cap 380 extends between a proximal end 386 and a distal end 388 along the vertical direction V. End cap 380 extends between a front portion 390 and a rear portion 392 along the lateral direction L and between a first side 394 and a second side 396 along the transverse direction T. The front portion 390 is the portion of end cap 380 that is visible if looking inward into recess 220 of one of doors 126, 128 of refrigerator appliance 100 (i.e., View A of FIG. 1, which is depicted in FIG. 2).

As shown particularly in FIGS. 8 and 9, end cap 380 includes a body 400 extending generally in a plane along the lateral and transverse directions L, T. End cap 380 also includes a rear wall 402 projecting from body 400 along the vertical direction V toward proximal end 386. Rear wall 402 is configured to mate with a rear wall of elongated body 320 (FIG. 11) when end cap 380 is connected with elongated body 320. Rear wall 402 of end cap 380 defines grooves or guide channels 404 along a forward surface 406 of rear wall 402 (FIG. 9). Guide channels 404 help constrain and shape wire guides 356 when handle lighting assembly 300 is assembled as shown in FIG. 10.

Figure 12:
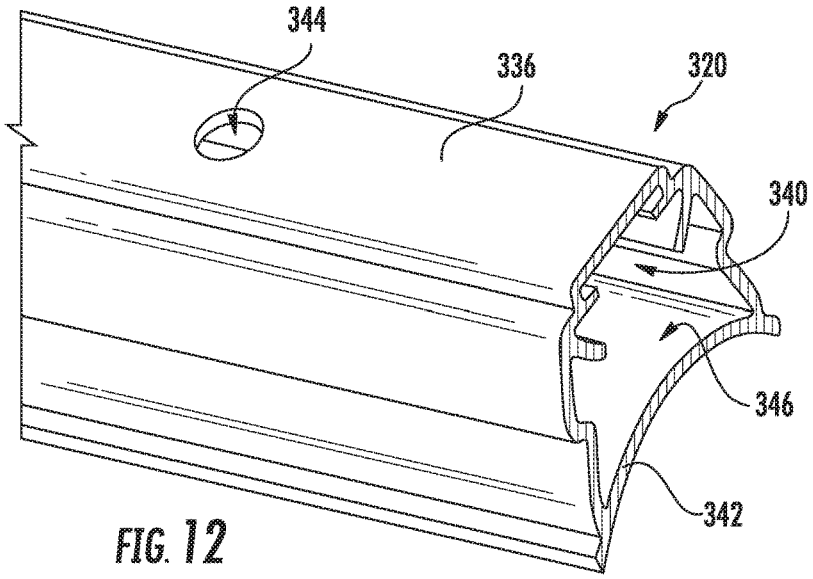
FIG. 12 provides a rear, perspective view of the elongated body of FIG. 11.

As shown in FIG. 9, end cap 380 also includes a connection member 408 projecting from body 400 along the vertical direction V toward proximal end 386. For this embodiment, connection member 408 projects from body 400 approximately midway between first side 394 and second side 396 along the transverse direction T of end cap 380. Connection member 408 includes a connecting portion 410. Connecting portion 410 projects generally rearward along the lateral direction L. Connecting portion 410 is operatively configured to snap into an opening 344 defined by elongated body 320 (FIG. 12). More particularly, rear wall 336 of elongated body 320 defines opening 344. In this way, connecting portion 410 of connection member 408 can snap into opening 344 to secure end cap 380 to elongated body 320 as shown in FIG. 11.

In addition, as further shown in FIG. 9, end cap 380 includes an arcuate support 412 projecting from body 400 along the vertical direction V towards proximal end 386. Arcuate support 412 is shaped generally complementary to the arcuate shape of lens 342 of elongated body 320 such that when end cap 380 is connected with elongated body 320, arcuate support 412 meshes into engagement with a rear surface 346 of lens 342 (FIGS. 11 and 12). Moreover, as depicted in FIG. 9, body 400 of end cap 380 includes an arcuate rim 414 positioned at or adjacent front portion 390 of end cap 380. When end cap 380 is connected with elongated body 320, as shown in FIG. 7, arcuate rim 414 forms a substantially seamless front surface of elongated body 320.

With reference to FIGS. 8 and 9, end cap 380 defines a slit 416. More particularly, for this embodiment, body 400 of end cap 380 defines slit 416. As shown, slit 416 extends substantially between the first and second sides 394, 396 of end cap 380 along the transverse direction T and is defined generally as an arcuate shape. Moreover, slit 416 is defined by body 400 such that when film 370 is inserted into slit 416, film 370 is positioned between light source 352 and lens 342. In addition, slit 416 is defined such that when film 370 is inserted into slit 416, film 370 becomes shaped in a generally arcuate shape.

As shown further in FIG. 9, end cap 380 includes guide members 418 extending from body 400 along the vertical direction V toward proximal end 386. Guide members 418 extend from body 400 proximate slit 416. In this way, when film 370 is inserted or removed from handle lighting assembly 300, guide members 418 assist a user with guiding film 370 into or out of handle lighting assembly 300. Moreover, particularly where film 370 is formed of a flexible material, guide members 418 prevent film 370 from bending or being displaced such that the emitted light does not pass through film 370.

As shown in FIGS. 7 and 8, end cap 380 defines an access recess 420 positioned on opposing sides of slit 416. Stated differently, end cap 380 defines a front access recess 422 defined forward of slit 416 along the lateral direction L and a rear access recess 424 defined rear or aft of slit 416 along the lateral direction L. Front and rear access recesses 422, 424 (collectively access recess 420) allow a user to easily insert or remove film 370 into or out of slit 416, or more broadly, handle lighting assembly 300. For example, a user may reach into access recess 420 with his or her fingers or an instrument (e.g., tweezers) to insert or remove film 370 from handle lighting assembly 300. In some exemplary embodiments, film 370 is flexible such that film 370 can be easily removed and inserted into handle lighting assembly 300.

With reference still to FIGS. 7 and 8, end cap 380 defines an access cutout 426. Access cutout 426 is defined by body 400 of end cap 380 proximate front portion 390. In particular, access cutout 426 is defined by body 400 and defines a void in arcuate rim 414. Moreover, for this embodiment, access cutout 426 is contiguous with access recess 420 positioned forward of slit 416.

Figure 13:
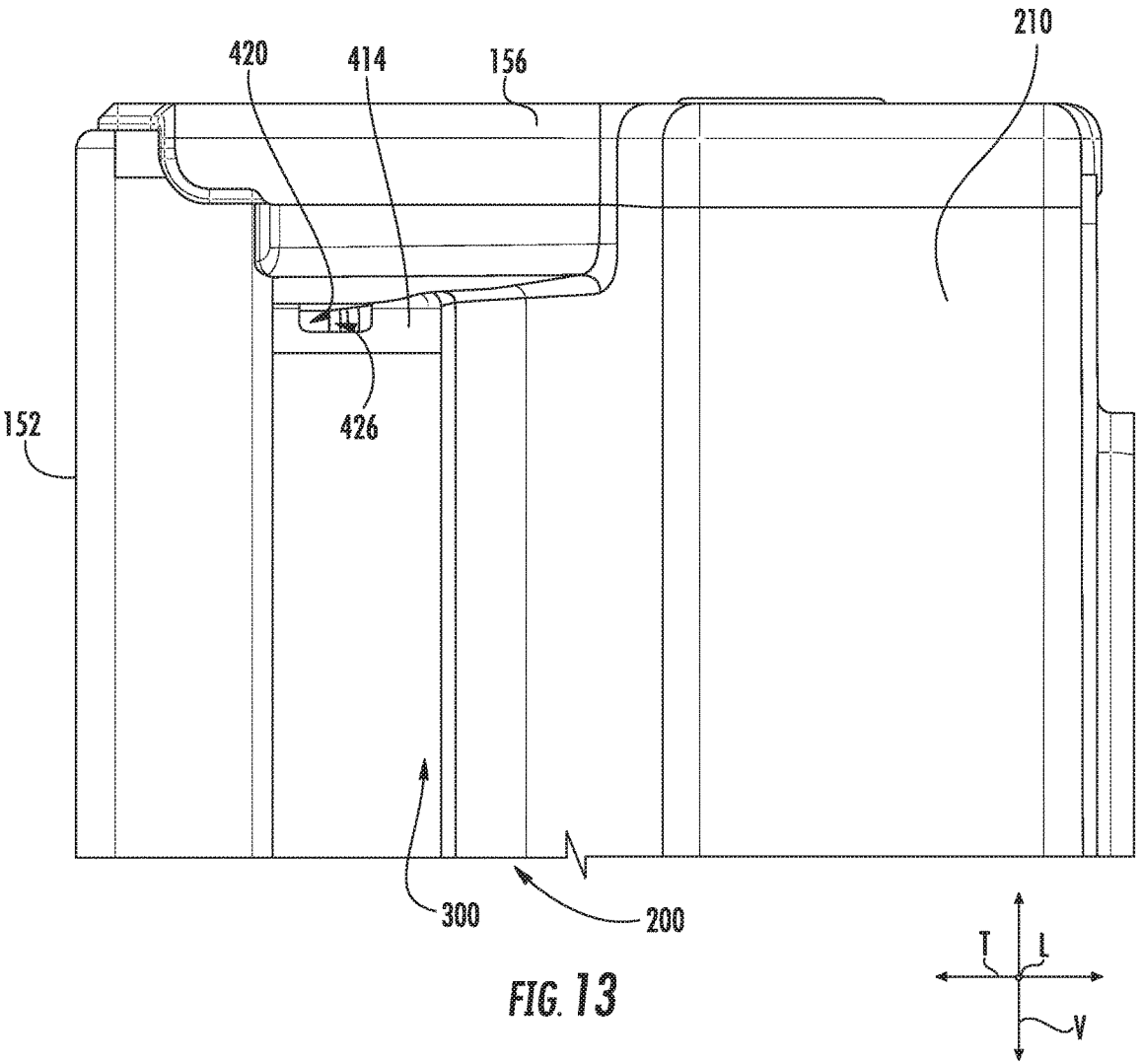
FIG. 13 provides a close up view of the top end of the exemplary handle assembly 200 of FIG. 2.

FIG. 13 provides a close up view of the top end of the exemplary handle assembly 200 of FIG. 2. As shown for this exemplary embodiment, handle lighting assembly 300 sits substantially flush with a top wall of handle body 210. Access cutout 426 provides access to access recess 420. In this manner, a consumer can more easily insert or remove film 370 from handle lighting assembly 300. In some embodiments, both end caps 382, 384 can include access cutouts 426. In this way, film 370 can be accessed for removal or inserted into handle lighting assembly 300 from either top 306 or bottom 308 of handle lighting assembly 300 (e.g., FIG. 2 or 3). In some alternative embodiments, one or both of the end caps do not include an access cutout 426. Rather, arcuate rim 414 has a continuous arcuate shape extending generally along the transverse direction T.

Figure 14:
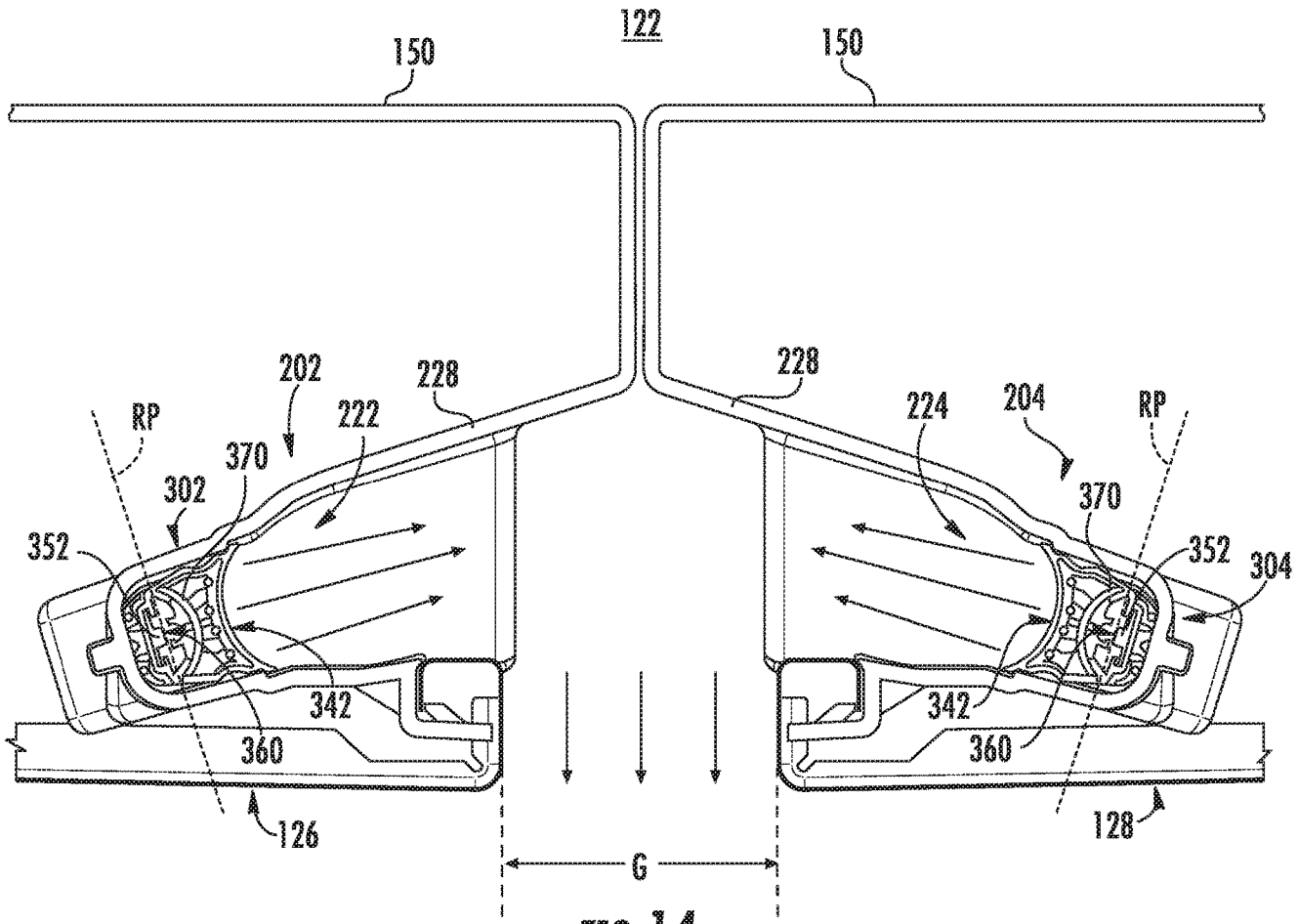
FIG. 14 provides a close up view of Section B of FIG. 4.

FIG. 14 provides a close up view of Section B of FIG. 4 depicting handle assemblies of refrigerator doors 126, 128, respectively. For this embodiment, the handle lighting assembly disposed within the recess of refrigerator door 126 is a first handle body assembly 202 and the handle lighting assembly disposed within the recess of refrigerator door 128 is a second handle body assembly 204. As shown in FIG. 14, first handle lighting assembly 302 is disposed within first recess 222 defined by first handle assembly 202 and second handle lighting assembly 304 is disposed within second recess 224 defined by second handle assembly 204. For each handle assembly 202, 204, a reference plane RP is disposed in a plane coplanar with a front face 360 or point of light source 352. For this embodiment, film 370 is concave with respect to reference plane RP and lens 342 is convex with respect to reference plane RP. Stated differently, film 370 is a diverging lens and lens 342 is a converging lens. As such, when light source 352 emits light from first handle assembly 202, the light initially passes through film 370. Film 370 changes the color of the light as it passes therethrough. Thus, the color of the emitted light is dependent upon the color of film 370. Due to the concavity or concave shape of film 370, the light diverges as it passes therethrough. The divergence of the light allows the light to spread out over the entire surface of lens 342. Accordingly, efficient use of the lumen intensity of the light emitted from light sources 352 is achieved. The diverging light, now having a particular color, passes through convex lens 342. Lens 342 converges or focuses the light at the rear sidewall 228 of the second handle assembly 204. The light may then reflect off of the rear sidewall 228 of the second handle assembly 204 and a portion of the reflected light can exit through gap G. Likewise, when light source 352 emits light from second handle assembly 204, the color of the light is similarly changed and the light is directed in the same manner as noted above for light emitted from first handle assembly 202. The light escaping through gap G provides refrigerator appliance 100 with a hue originating from the pocket handles of refrigerator appliance 100 (e.g., FIG. 1). In this way, the aesthetic appearance and ease of use of refrigerator appliance 100 can be enhanced.

In some exemplary embodiments, a handle lighting assembly can be removably coupled with a handle body. In such embodiments, the coupling of the handle lighting assembly with handle body can allow for handle lighting assembly to pivot or otherwise move relative to handle body. In this way, a user may readily access handle lighting assembly to insert or remove film such that handle lighting assembly can emit a desired color of light. Moreover, in some exemplary embodiments, the coupling of handle lighting assembly with handle body can allow for handle lighting assembly to be completely removed from handle body.

Figure 15:
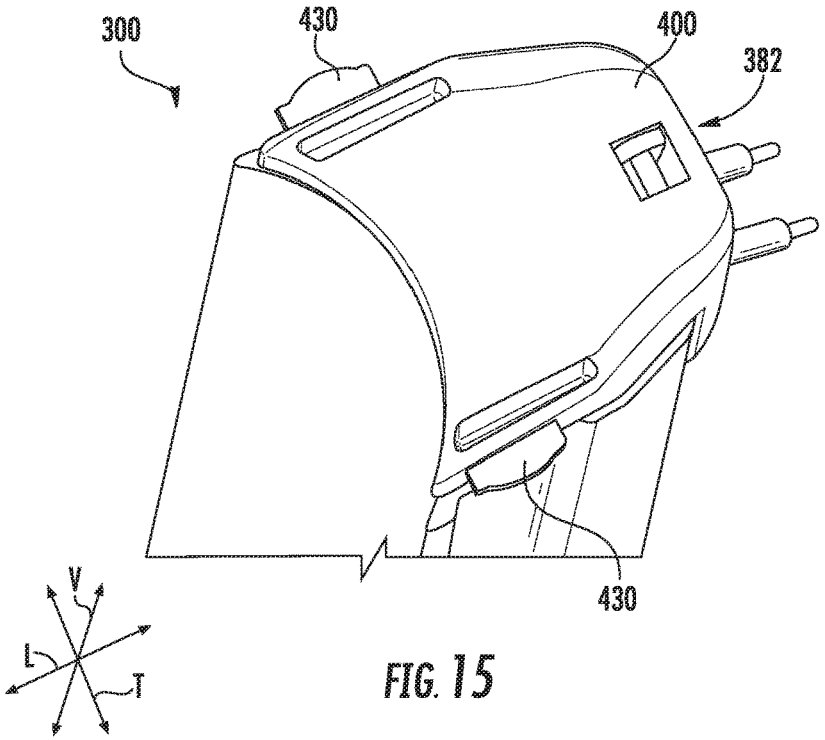
FIG. 15 provides a close up, top perspective view of an end cap of an exemplary lighting assembly according to an exemplary embodiment of the present subject matter.
Figure 16:
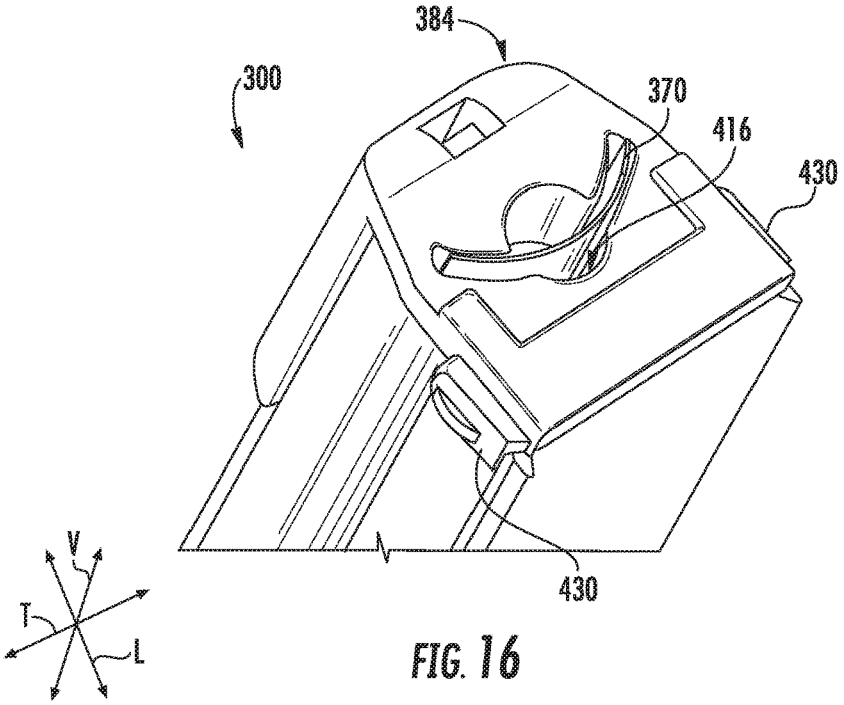
FIG. 16 provides a close up, bottom perspective view of another end cap of an exemplary lighting assembly according to an exemplary embodiment of the present subject matter.

With reference now to FIGS. 15 and 16, FIG. 15 provides a close up, top perspective view of an exemplary first end cap 382 of an exemplary handle lighting assembly 300 and FIG. 16 provides a close up, bottom perspective view of a second bottom end cap 384 of the exemplary handle lighting assembly 300 of FIG. 15 according to an exemplary embodiment of the present subject matter. For this exemplary embodiment, first end cap 382 is not the same as second end cap 384. As shown in FIG. 15, first end cap 382 includes tabs 430 projecting outward from body 400. Likewise, as shown in FIG. 16, second end cap 384 includes tabs 430 projecting outward from body 400. In particular, the tabs 430 of the first end cap 382 and tabs 430 of second end cap 384 project outward from body 400 along the transverse direction T and each extend a distance along the lateral direction L. Tabs 430 also have a thickness along the vertical direction V.

As further shown in FIGS. 15 and 16, for this embodiment, first end cap 382 does not define a slit. However, as shown in FIG. 16, second end cap 384 defines slit 416. Accordingly, a user may only access film 370 from one of the ends of the lighting assembly 300.

Figure 17:
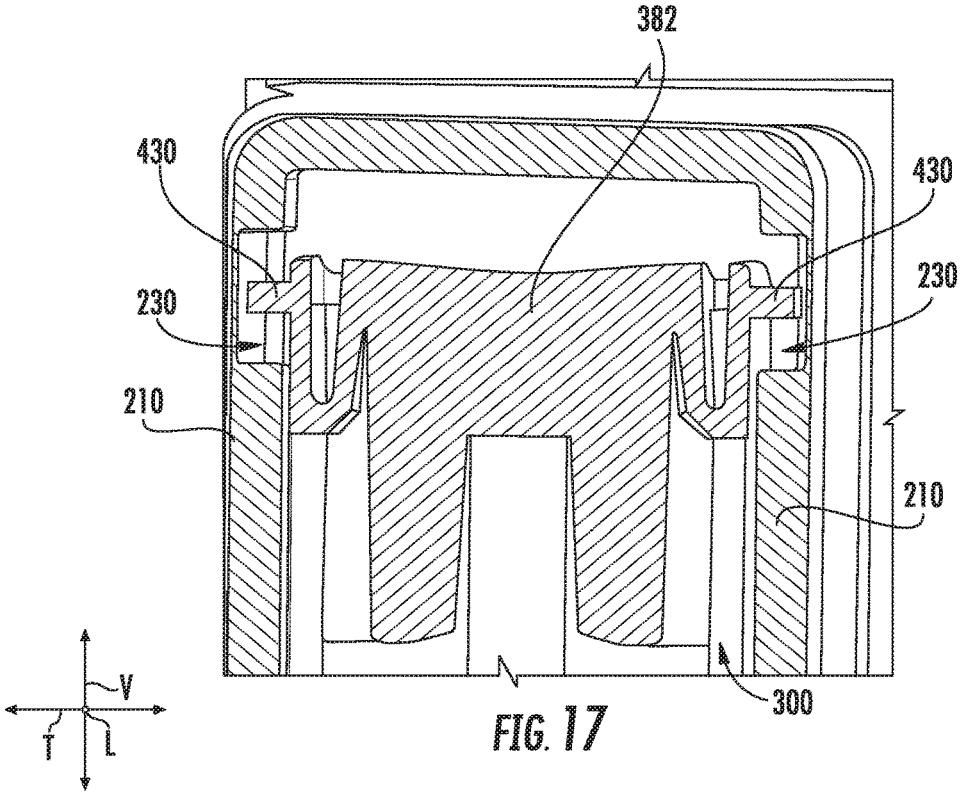
FIG. 17 provides an elevation, cross-sectional view of the end cap of FIG. 15 removably coupled with an exemplary handle body according to an exemplary embodiment of the present subject matter.
Figure 18:
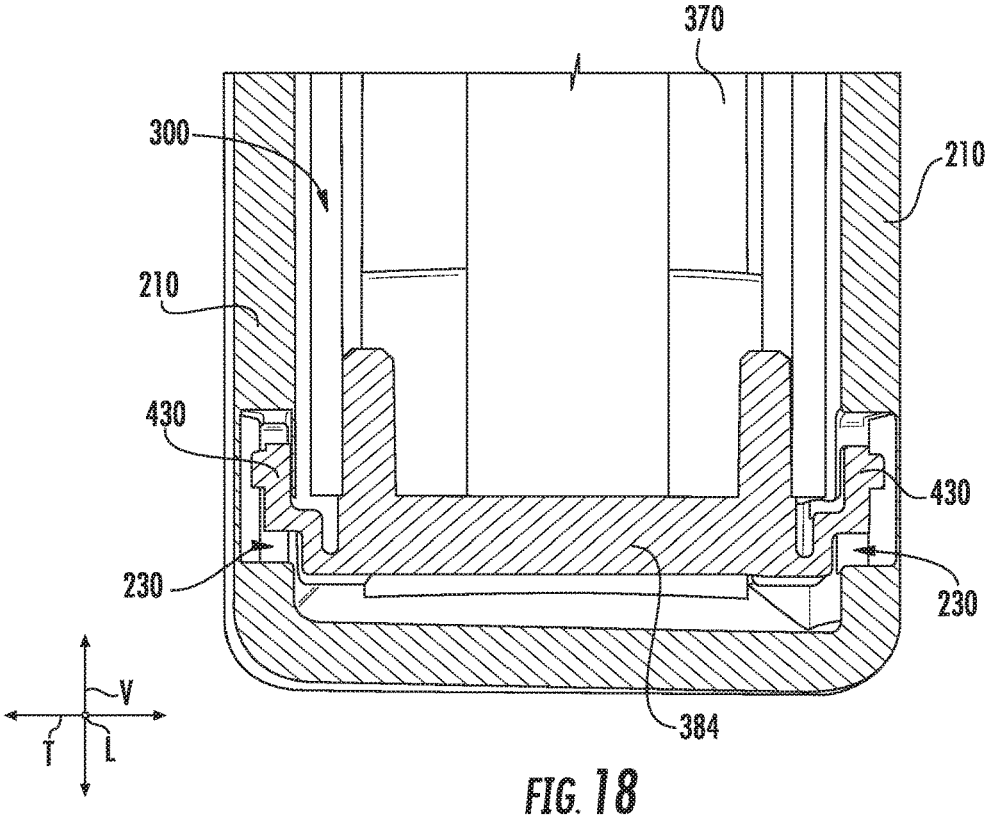
FIG. 18 provides an elevation, cross-sectional view of the end cap of FIG. 16 removably coupled with an exemplary handle body according to an exemplary embodiment of the present subject matter.
Figure 19:
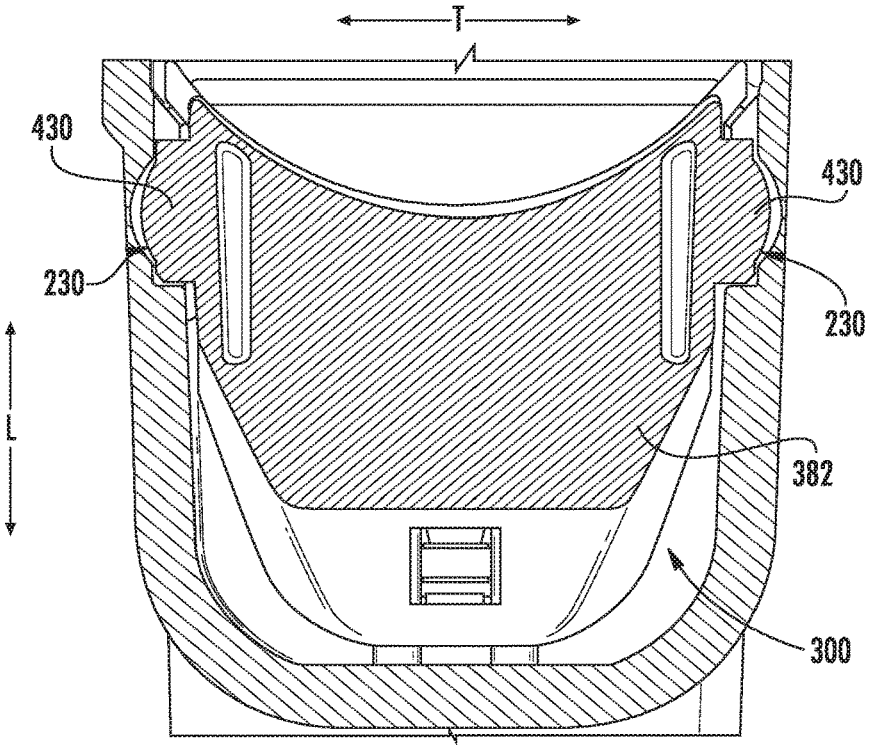
FIG. 19 provides a plan, cross-sectional view of the end cap of FIG. 15 removably coupled with an exemplary handle body according to an exemplary embodiment of the present subject matter.
Figure 20:
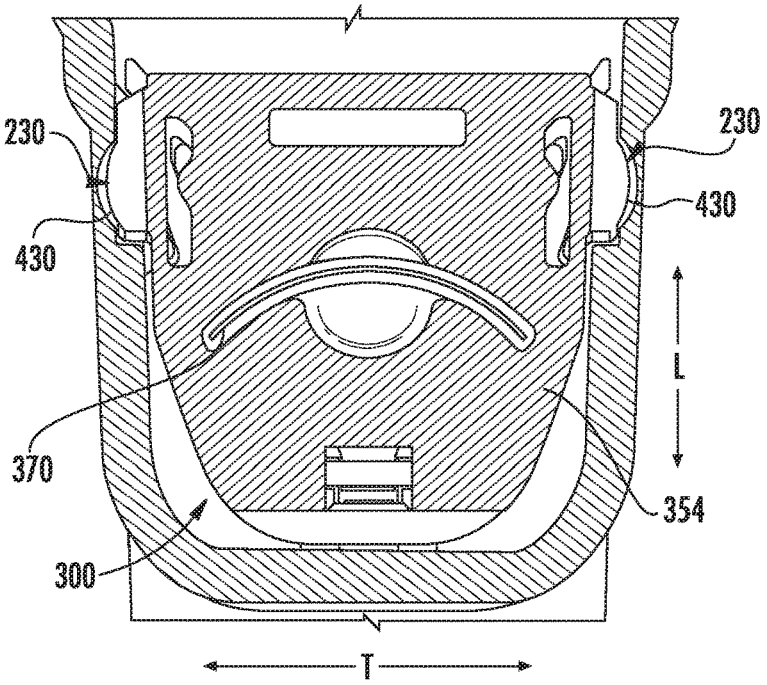
FIG. 20 provides a plan, cross-sectional view of the end cap of FIG. 16 removably coupled with an exemplary handle body according to an exemplary embodiment of the present subject matter.

With reference now to FIGS. 17 through 20, FIG. 17 provides an elevation, cross-sectional view of first end cap 382 removably coupled with an exemplary handle body 210 according to an exemplary embodiment of the present subject matter. FIG. 18 provides an elevation, cross-sectional view of second end cap 384 removably coupled with handle body 210 according to an exemplary embodiment of the present subject matter. FIG. 19 provides a plan, cross-sectional view of first end cap 382 of FIG. 15 removably coupled with handle body 210 according to an exemplary embodiment of the present subject matter. FIG. 20 provides a plan, cross-sectional view of second end cap 284 of FIG.

16 removably coupled with handle body 210 according to an exemplary embodiment of the present subject matter.

As shown in FIG. 17, tabs 430 of first end cap 382 are operatively configured to be received within corresponding indents 230 defined by handle body 210 when handle lighting assembly 300 is inserted into handle body 210. Likewise, as shown in FIG. 18, tabs 430 of second end cap 384 are operatively configured to be received within corresponding indents 230 defined by handle body 210 when handle lighting assembly 300 is inserted into handle body 210. FIG. 19 depicts tabs 430 of first end cap 382 received within corresponding indents 230 of handle body 210. FIG. 20 depicts tabs 430 of second end cap 384 received within corresponding indents 230 of handle body 210. To secure handle lighting assembly 300 into handle body 210, various tabs 430 of the end caps 382, 384 are inserted into their respective complementarily-shaped indents 230. To remove handle lighting assembly 300 from handle body 210, a consumer may urge handle lighting assembly 300 upward along the vertical direction V to disengage tabs 430 from their corresponding indents 230. Thereafter, handle lighting assembly 300 can be removed from handle body 210 such that film 370 can be accessed from second end cap 384.

Figure 21:
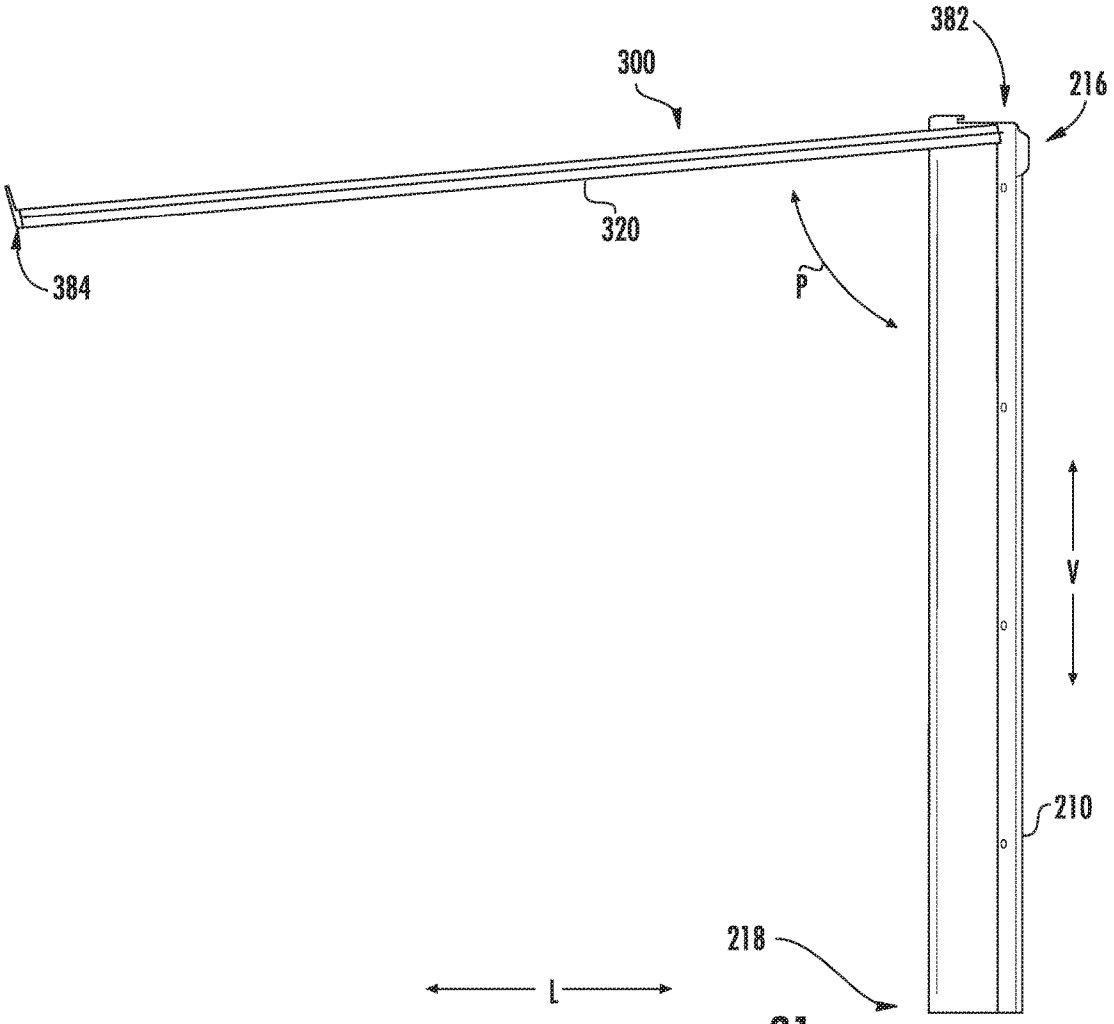
FIG. 21 provides a perspective view of an exemplary lighting assembly being detached from a handle body of an exemplary handle assembly according to an exemplary embodiment of the present subject matter.

In some exemplary embodiments, handle lighting assembly 300 can be pivoted from the body 210 such that a user may access film 370 at second end cap 384. By way of example, FIG. 21 provides a perspective view of an exemplary handle lighting assembly 300 being pivoted from an exemplary handle body 210 of an according to an exemplary embodiment of the present subject matter. As shown, handle lighting assembly 300 is operatively coupled to handle body 210 at top 216 of handle body 210 and handle lighting assembly 300 is detached from handle body 210 at bottom 218 of handle body 210. As shown, to access film 370 or insert a new film, a user can pivot handle lighting assembly 300 from a generally vertical orientation to a generally lateral orientation. In this way, a user can readily access second end cap 284 to insert or remove a film. Tabs 430 of first end cap 382 can function as a trunnion to allow for pivotal movement of handle lighting assembly 300 and yet remain operatively coupled to handle body 210. Other suitable methods for operatively coupling first end cap 382 with handle body 210 are contemplated.

In some exemplary embodiments, handle lighting assembly 300 can be configured to rotate between 0° to 90° degrees. In certain embodiments, the maximum rotation of handle lighting assembly 300 is about 85° with respect to the vertical direction V. The rotation of handle lighting assembly 300 allows a user to angle handle lighting assembly 300 for removal and/or insertion of a film, as noted above. Additionally or alternatively, handle lighting assembly 300 can be completely removed from handle body 210 for removal and insertion of a film. In yet further exemplary embodiments, handle lighting assembly 300 can be fixed to handle body 210 or formed as part of handle body 210 (i.e., FIGS. 1-14 and the accompanying text).

Although first end cap and second end cap were described and illustrated as having particular configurations, it will be appreciated that first end cap can be operatively configured in the same or similar manner as second end cap and that second end cap can be operatively configured in the same or similar manner as first end cap. Stated differently, the roles and configurations of first and second end caps can be reversed.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance defining a vertical direction, a lateral direction, and a transverse direction, the refrigerator appliance comprising:
- a cabinet;
- a door rotatably hinged with the cabinet, the door having a length extending between a first end and a second end along a direction orthogonal to the transverse direction;
- a handle assembly connected with or integrally formed with the door and having a handle body defining a recess, the handle assembly further comprising:
  - a lighting assembly connected to the handle body and disposed within the recess, the lighting assembly comprising:
    - an elongated body having a length extending between a first end and a second end and having a lens extending along at least a portion of the length;
    - a light source;
    - an end cap integral with or operatively connected to the elongated body at one of the first end and the second end, the end cap defining a slit; and
    - a film removably insertable into the slit, wherein when the film is received within the slit, the film extends at least half the length of the door,
    - wherein when the film is inserted into the slit, the film is positioned between the light source and the lens.

2. The refrigerator appliance of claim 1, wherein the end cap defines an access recess positioned on opposing sides of the slit, and wherein the access recess allows for removal and insertion of the film within or from the slit.

3. The refrigerator appliance of claim 2, wherein the lens has an arcuate shape, and wherein the end cap has a body having an arcuate rim shaped complementary to the arcuate shape of the lens, and wherein the arcuate rim defines an access cutout contiguous with the access recess for providing access to the film.

4. The refrigerator appliance of claim 3, wherein the arcuate rim and the lens together form a seamless front surface of the elongated body.

5. The refrigerator appliance of claim 1, wherein the lens extends substantially along the entire length of the elongated body.

6. The refrigerator appliance of claim 1, wherein the length of the door extends longitudinally along the vertical direction, and wherein the film extends substantially the length of the door along the vertical direction.

7. The refrigerator appliance of claim 1, wherein the end cap is a first end cap connected to the first end of the elongated body, and wherein the handle lighting assembly further comprises:
- a second end cap connected to the second end of the elongated body and defining a slit;
- wherein when the film is inserted into the slit of the first end cap, the film is received within the slit of the second end cap.

8. The refrigerator appliance of claim 1, wherein the film extends substantially along the entire length of the elongated body.

9. The refrigerator appliance of claim 1, wherein the refrigerator appliance defines a lateral direction, the cabinet extending between a first side and a second side along the lateral direction, wherein the door is rotatably hinged at the first side of the cabinet, the refrigerator appliance further comprising:

a second door rotatably hinged to the second side of the cabinet;

a handle assembly connected with or integrally formed with the second door and having a handle body defining a recess;

a handle lighting assembly connected to the handle body and disposed within the recess defined by the handle body of the second door, the handle lighting assembly comprising:

an elongated body having a length extending from a first end to a second end and having a lens extending along at least a portion of the length;

a light source;

an end cap operatively connected with the elongated body at one of the first end and the second end, the end cap defining a slit;

a film removably insertable into the slit;

wherein when the film is inserted into the slit, the film is positioned between the light source and the lens;

wherein when the door and the second door are in a closed position, the recess defined by the handle body of the door and the recess defined by the handle body of the second door define an illumination recess, and wherein a gap is defined between the door and the second door along the lateral direction such that when one or more of the light sources of the respective handle lighting assemblies emit light, the light from within the illumination recess is visible from an exterior of the refrigerator appliance.

10. The refrigerator appliance of claim 1, wherein the lens is oriented with a convex shape with respect to the light source as viewed from the vertical direction, and wherein when the film is inserted into the slit, the film is oriented with a concave shape with respect to the light source as viewed from the vertical direction.

11. The refrigerator appliance of claim 1, wherein the end cap pivotally couples the handle lighting assembly with the handle body.

12. The refrigerator appliance of claim 11, wherein the handle lighting assembly is rotatable relative to the handle body between zero and ninety degrees.

13. The refrigerator appliance of claim 11, wherein the end cap has a body and tabs projecting outward form the body in opposing directions, and wherein the handle body defines indents operable to receive the tabs of the end cap, and wherein the tabs pivotally couple the handle lighting assembly with the handle body.

14. A handle assembly for an appliance defining a vertical direction, a lateral direction, and a transverse direction, the handle assembly comprising:

a handle body defining a recess;

a lighting assembly connected to the handle body and disposed within the recess, the lighting assembly comprising:

an elongated body having a length extending from a first end to a second end and having a lens extending along at least a portion of the length;

a light source;

an end cap operatively connected with the elongated body at one of the first end and the second end, the end cap defining a slit; and a film removably insertable into the slit, wherein when the film is inserted into the slit, the film is positioned between the light source and the lens and the lens is oriented with a convex shape with respect to the light source as viewed from the vertical direction and the film is oriented with a concave shape with respect to the light source as viewed from the vertical direction.

15. The handle assembly of claim 14, wherein the end cap has a body and one or more guide members projecting from the body along the vertical direction for guiding the film into and out of the slit, the one or more guide members extending at least partially along the length of the elongated body.

16. The handle assembly of claim 14, wherein the elongated body defines an opening positioned along the length of the elongated body, and wherein the end cap has a body and a connection member projecting from the body at least partially along the length of the elongated body, the connection member having a connecting portion projecting from the connection member in a direction orthogonal to the vertical direction, the connecting portion operatively configured to snap into the opening to secure the end cap to the elongated body thereto.

17. The handle assembly of claim 14, wherein the end cap defines an access recess positioned on opposing sides of the slit, and wherein the access recess allows for removal and insertion of the film within or from the slit, and wherein the end cap defines an access cutout contiguous with the access recess for providing access to the film.

18. The handle assembly of claim 14, wherein the handle body defines at least two indents, and wherein the end cap has a body and tabs projecting outward from the body, and wherein the tabs are operatively configured to be received within the indents.

19. A refrigerator appliance defining a vertical direction, the refrigerator appliance comprising:

a cabinet;

a door rotatably hinged with the cabinet, the door having a vertical length extending between a top wall and a bottom wall;

a handle assembly connected with or integrally formed with the door and having a handle body defining a recess, the handle assembly further comprising:

a lighting assembly connected to the handle body and disposed within the recess, the lighting assembly comprising:

an elongated body having a length extending between a top end and a bottom end and having a lens extending along at least a portion of the length, the elongated body defining a hollow interior;

a light source;

an end cap connected to the elongated body at one of the top end and the bottom end, the end cap defining a slit;

a film removably insertable into the lighting assembly, wherein when the film is inserted into the lighting assembly, the film extends through the slit of the end cap and into the hollow interior of the elongated body such that the film extends at least half the vertical length of the door;

wherein when the film is inserted into the slit, the film is positioned between the light source and the lens.

20. The refrigerator appliance of claim 19, wherein when the film is inserted into the lighting assembly, the lens is oriented with a convex shape with respect to the light source as viewed from the vertical direction and the film is oriented with a concave shape with respect to the light source as viewed from the vertical direction.

* * * * *